US012415701B2

(12) United States Patent
Ueno et al.

(10) Patent No.: US 12,415,701 B2
(45) Date of Patent: Sep. 16, 2025

(54) SHEET DISCHARGER, AND SHEET POST-PROCESSOR, IMAGE FORMING APPARATUS, AND IMAGE FORMING SYSTEM PROVIDED WITH THE SHEET DISCHARGER

(71) Applicant: KYOCERA Document Solutions Inc., Osaka (JP)

(72) Inventors: Yasunori Ueno, Osaka (JP); Keisuke Egawa, Osaka (JP); Yusuke Takano, Osaka (JP); Takehiko Okada, Osaka (JP); Takuya Nishimura, Osaka (JP); Terumitsu Noso, Osaka (JP); Seiichi Shirasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 57 days.

(21) Appl. No.: 18/420,344

(22) Filed: Jan. 23, 2024

(65) Prior Publication Data

US 2024/0253935 A1 Aug. 1, 2024

(30) Foreign Application Priority Data

Jan. 30, 2023 (JP) ..... 2023-012101

(51) Int. Cl.
*B65H 31/26* (2006.01)
*B65H 31/10* (2006.01)

(52) U.S. Cl.
CPC ..... *B65H 31/26* (2013.01); *B65H 31/10* (2013.01); *B65H 2301/4223* (2013.01); *B65H 2801/27* (2013.01)

(58) Field of Classification Search
CPC ..... B65H 31/10; B65H 31/26
See application file for complete search history.

(56) References Cited

U.S. PATENT DOCUMENTS 8,910,934 B2 * 12/2014 Yamazaki ..... B65H 31/36 271/189
9,008,568 B2 * 4/2015 Shimura ..... B65H 29/14 399/407
10,150,637 B2 * 12/2018 Wakayama ..... B65H 31/3009
(Continued)

FOREIGN PATENT DOCUMENTS

JP 2013-230928 A 11/2013
JP 2013-241270 A 12/2013

*Primary Examiner* — Patrick Cicchino
(74) *Attorney, Agent, or Firm* — Stein IP, LLC

(57) ABSTRACT

A sheet discharger includes a sheet discharge outlet, a discharge member, a sheet discharge tray, a sheet hold-down member, a drive portion, and a control portion. The sheet discharge tray is disposed downstream from the sheet discharge outlet with respect to a discharge direction and is a tray on which a sheet discharged through the sheet discharge outlet is loaded. The sheet hold-down member is swingable between a hold-down position at which the sheet loaded on the sheet discharge tray is held down at an upstream part thereof in the discharge direction and a retracted position retracted upward from the hold-down position. The drive portion drives the sheet hold-down member. The control portion determines, in accordance with characteristics of the sheet, whether or not to execute a sheet hold-down operation in which the sheet hold-down member is moved to the retracted position and to the hold-down position.

9 Claims, 7 Drawing Sheets

(56) References Cited

U.S. PATENT DOCUMENTS

| | | | | |
|---|---|---|---|---|
| 10,745,231 | B2 * | 8/2020 | Deocon Mir | B65H 31/26 |
| 10,822,192 | B2 * | 11/2020 | Kotani | B65H 43/08 |
| 2013/0285305 | A1 | 10/2013 | Gamo | 270/58.08 |
| 2013/0292897 | A1 | 11/2013 | Ando et al. | 271/220 |
| 2015/0239702 | A1 * | 8/2015 | Sugiyama | B65H 33/08<br>271/220 |

* cited by examiner

SHEET DISCHARGER, AND SHEET POST-PROCESSOR, IMAGE FORMING APPARATUS, AND IMAGE FORMING SYSTEM PROVIDED WITH THE SHEET DISCHARGER

INCORPORATION BY REFERENCE

This application is based upon and claims the benefit of priority from the corresponding Japanese Patent Application No. 2023-12101 (filed on Jan. 30, 2023), the entire contents of which are incorporated herein by reference.

BACKGROUND

The present disclosure relates to a sheet discharger that discharges a sheet after being subjected to image formation by an image forming apparatus, and a sheet prost-processor, the image forming apparatus, and an image forming system that are provided with the sheet discharger.

An image forming apparatus such as a copy machine or a printer and a sheet post-processor that performs post-processing on a sheet are each provided with a sheet discharger including a discharge roller pair and a discharge tray. A sheet (a sheet of paper) after being subjected to image formation by the image forming apparatus is discharged on the discharge tray by the sheet discharger provided in the image forming apparatus. Alternatively, after being carried into the sheet post-processor and subjected to a prescribed type of post-processing therein, the sheet is discharged on the discharge tray by the sheet discharger provided in the sheet post-processor.

In the sheet discharger described above, in a case where sheets have already been loaded on the discharge tray, a succeeding sheet might push out any of the loaded sheets, causing a loaded state of the sheets to be disordered or the any of the loaded sheets to fall from the discharge tray. Furthermore, in a case of discharging a largely curled sheet, when discharged in such a curled state, the sheet might clog a sheet discharge outlet to cause a sheet discharge failure. As a solution thereto, a method has been adopted in which a sheet discharged on the discharge tray through the sheet discharge outlet is held down at a trailing end thereof.

SUMMARY

A sheet discharger according to an aspect of the present disclosure includes a sheet discharge outlet, a discharge member, a sheet discharge tray, a sheet hold-down member, a drive portion, and a control portion. The sheet discharge outlet is a port through which a sheet is discharged. The discharge member is disposed at the sheet discharge outlet and conveys the sheet in a discharge direction. The sheet discharge tray is disposed downstream from the sheet discharge outlet with respect to the discharge direction and is a tray on which the sheet discharged through the sheet discharge outlet is loaded. The sheet hold-down member is disposed below the sheet discharge outlet and is swingable between a hold-down position at which the sheet loaded on the sheet discharge tray is held down at an upstream part thereof in the discharge direction and a retracted position retracted upward from the hold-down position. The drive portion drives the sheet hold-down member. The control portion controls the drive portion. The control portion is capable of executing, every time the sheet is discharged on the sheet discharge tray, a sheet hold-down operation in which the sheet hold-down member disposed at the hold-down position is moved to the retracted position at a timing when a trailing end of the sheet discharged through the sheet discharge outlet passes through the discharge member, and the sheet hold-down member is moved from the retracted position to the hold-down position at a timing when loading of the sheet on the sheet discharge tray is completed. The control portion determines, in accordance with characteristics of the sheet, whether or not to execute the sheet hold-down operation.

DETAILED DESCRIPTION

[1. Configuration of Image Forming System]

Figure 1:
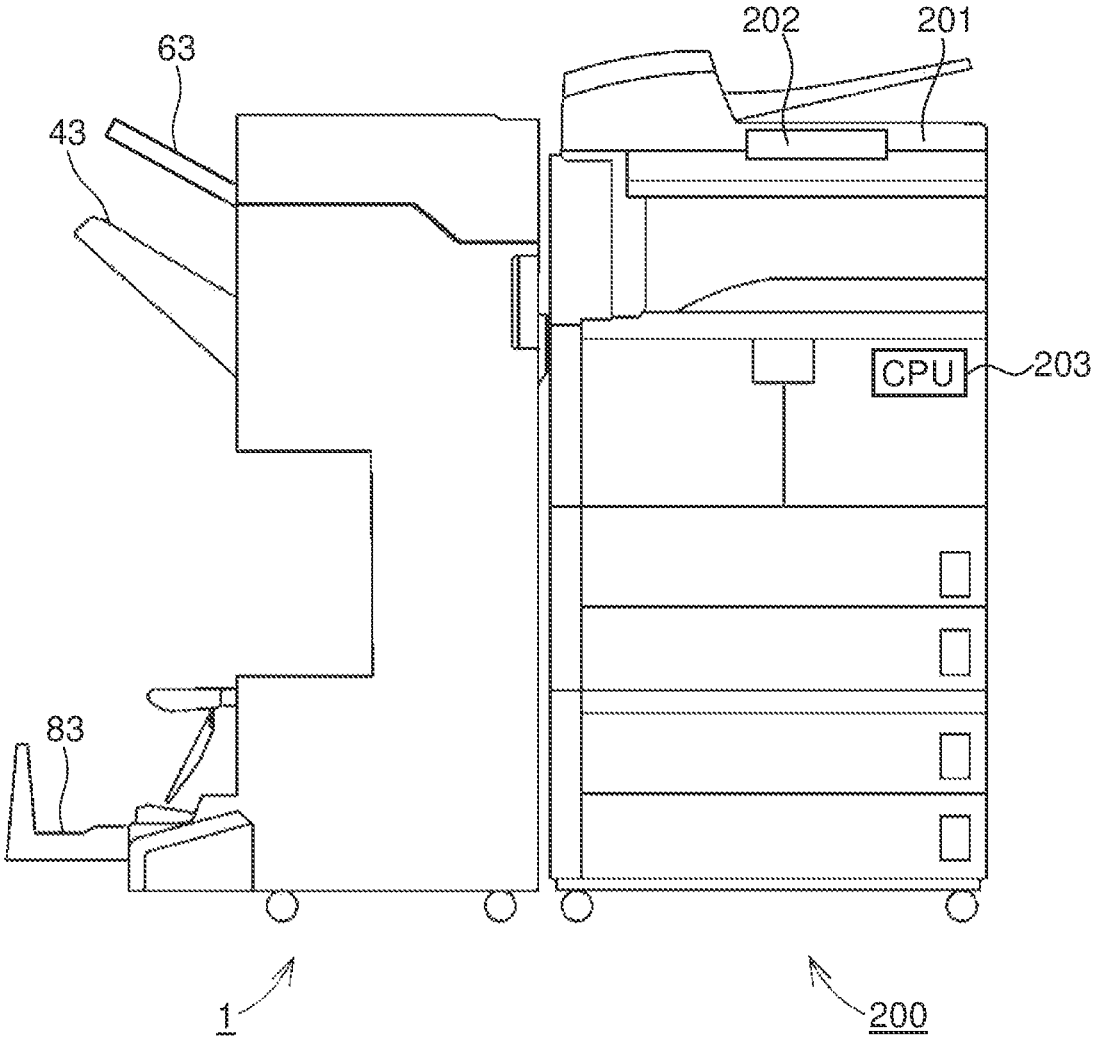
FIG. 1 a schematic view showing a configuration of an image forming system composed of a sheet post-processor according to one embodiment of the present disclosure and an image forming apparatus to which the sheet post-processor is connected.

With reference to the appended drawings, the following describes an embodiment of the present disclosure in detail. FIG. 1 is a schematic view showing a configuration of an image forming system composed of a sheet post-processor 1 according to one embodiment of the present disclosure and an image forming apparatus 200 to which the sheet post-processor 1 is connected.

As shown in FIG. 1, based on image data externally inputted via an unshown network communication portion or image data read by an image reading portion 201 disposed in an upper part of the image forming apparatus 200, the image forming apparatus 200 prints an image on a sheet (a sheet of paper). In the present embodiment, the image forming apparatus 200 is an inkjet recording apparatus including recording heads (not shown) of different colors each having a multitude of nozzle orifices for ejecting ink to the sheet.

An operation panel 202 is disposed in front of the image reading portion 201. The operation panel 202 is an operation portion for accepting inputs of various types of settings. For example, by operating the operation panel 202, a user can input size information of the sheet. Furthermore, by operating the operation panel 202, a user can also input the number of sheets to be subjected to printing or an instruction to start a printing job. A main body control portion 203 performs centralized control of operations of the image forming apparatus 200 as a whole and controls the various portions of the image forming apparatus 200.

The sheet post-processor 1 is detachably connected to a side surface of the image forming apparatus 200. The sheet post-processor 1 performs post-processing such as a punch hole forming process or a binding process with respect to the sheet after being subjected to image formation (printing) by the image forming apparatus 200. The sheet post-processor 1 is not limited to a configuration of performing post-processing on the sheet automatically conveyed from the image forming apparatus 200 but may also perform post-processing on the sheet placed on an unshown tray by a user and conveyed by the sheet post-processor 1 itself to a position allowing the post-processing to be performed.

[2. Configuration of Sheet Post-Processor]

Figure 2:
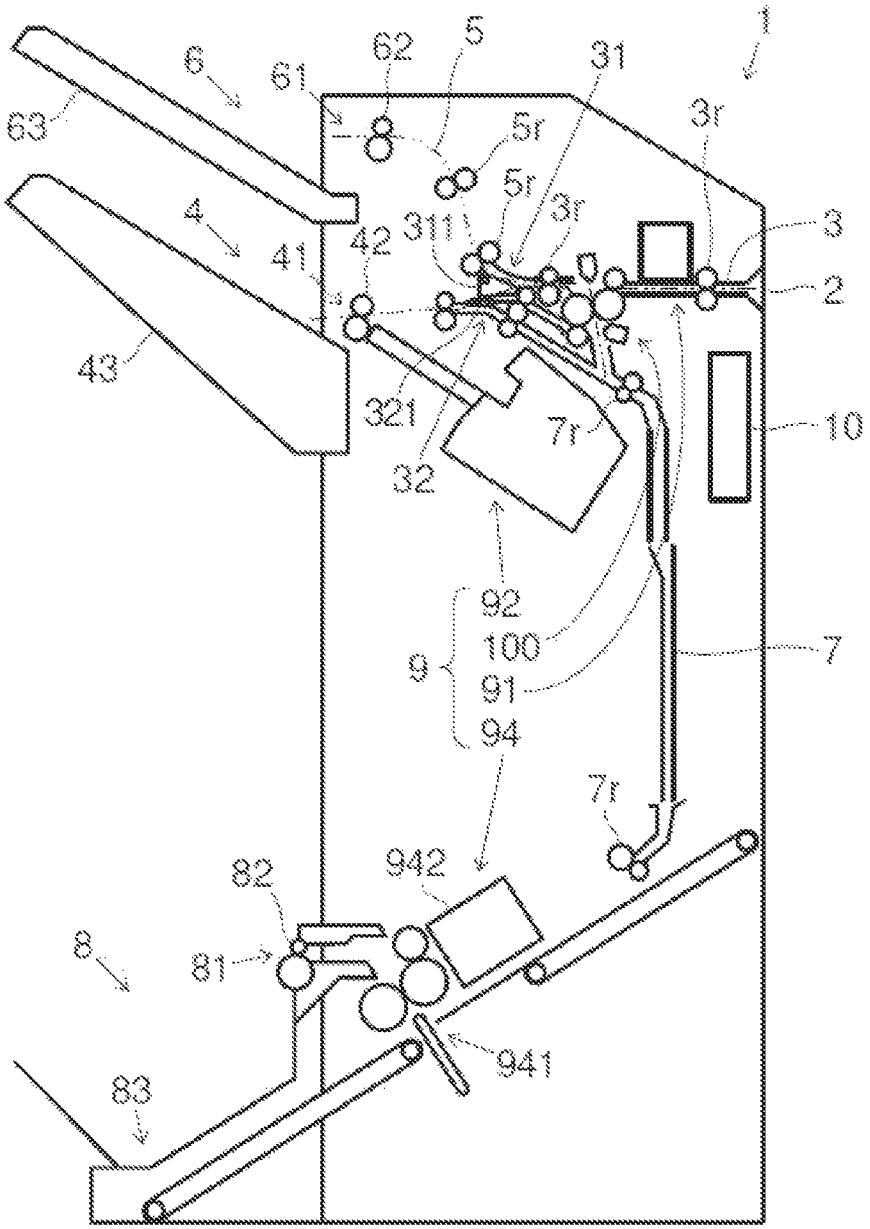
FIG. 2 is a sectional side view schematically showing a configuration of the sheet post-processor of the present embodiment.

FIG. 2 is a sectional side view schematically showing a configuration of the sheet post-processor 1 of the present embodiment. As shown in FIG. 2, the sheet post-processor 1 includes a sheet carry-in inlet 2, a first sheet conveyance path 3, a first sheet discharge portion 4, a second sheet conveyance path 5, a second sheet discharge portion 6, a third sheet conveyance path 7, a third sheet discharge portion 8, a post-processing section 9, and a post-processing control portion (a control portion) 10.

The sheet carry-in inlet 2 is an opening provided in a side surface of the sheet post-processor 1 opposed to the image forming apparatus 200. The sheet being conveyed from the image forming apparatus 200 toward the sheet post-processor 1 passes through the sheet carry-in inlet 2 to be carried into the sheet post-processor 1.

The first sheet conveyance path 3 extends substantially horizontally from the sheet carry-in inlet 2 to the first sheet discharge portion 4 in a direction away from the image forming apparatus 200 (a leftward direction in FIG. 2). A direction directed from the sheet carry-in inlet 2 toward the first sheet discharge portion 4 is referred to as a sheet conveyance direction on the first sheet conveyance path 3. The sheet carry-in inlet 2 is positioned at an upstream end of the first sheet conveyance path 3 in the sheet conveyance direction. The first sheet conveyance path 3 includes a plurality of conveyance roller pairs 3*r* and conveys, toward downstream in the sheet conveyance direction, the sheet carried into the sheet post-processor 1 through the sheet carry-in inlet 2.

The first sheet discharge portion 4 is provided on a side surface of the sheet post-processor 1 opposite to the side surface thereof opposed to the image forming apparatus 200.

The first sheet discharge portion 4 is disposed at a downstream end of the first sheet conveyance path 3 in the sheet conveyance direction. The first sheet discharge portion 4 includes a first discharge outlet 41, a first discharge roller pair 42, and a first discharge tray 43.

The first discharge outlet 41 is positioned at the downstream end of the first sheet conveyance path 3 in the sheet conveyance direction. The first discharge roller pair 42 is disposed at the first discharge outlet 41. The first discharge tray 43 is positioned downstream from the first discharge outlet 41 in the sheet conveyance direction. The sheet that has been conveyed on the first sheet conveyance path 3 to reach the first discharge outlet 41 is caused to pass through the first discharge outlet 41 by the first discharge roller pair 42 to be discharged on the first discharge tray 43. The first discharge tray 43 is one of locations at which the sheet subjected to post-processing by the sheet post-processor 1 is eventually discharged.

The second sheet conveyance path 5 branches off from a first branch portion (a branch portion) 31 on the first sheet conveyance path 3 to extend laterally in the direction away from the image forming apparatus 200 (the leftward direction in FIG. 2) and upwardly to the second sheet discharge portion 6. The first branch portion 31 is disposed downstream from a perforation portion 91 with respect to the sheet conveyance direction on the first sheet conveyance path 3. A direction directed from the first branch portion 31 toward the second sheet discharge portion 6 is referred to as a sheet conveyance direction on the second sheet conveyance path 5. The first branch portion 31 is positioned at an upstream end of the second sheet conveyance path 5 in the sheet conveyance direction. The second sheet conveyance path 5 includes a plurality of conveyance roller pairs 5*r* and conveys the sheet being conveyed on the first sheet conveyance path 3 so that a conveyance direction of the sheet is changed at the first branch portion 31 toward the second sheet discharge portion 6.

The first branch portion 31 includes a first switching guide 311. The first switching guide 311 pivots to a position at which the sheet being conveyed on the first sheet conveyance path 3 from the sheet carry-in inlet 2 is guided to the first discharge outlet 41 along the first sheet conveyance path 3 and to a position at which the conveyance direction of the sheet is changed from that on the first sheet conveyance path 3 so that the sheet is guided to the second sheet conveyance path 5. The first switching guide 311 further pivots to a position at which the sheet that has been subjected to a folding process is guided to the second sheet conveyance path 5. The first switching guide 311 is connected to a drive mechanism (not shown), and an operation thereof is controlled by a post-processing control portion 10.

The second sheet discharge portion 6 is provided on the side surface of the sheet post-processor 1 opposite to the side surface thereof opposed to the image forming apparatus 200 and above the first sheet discharge portion 4. The second sheet discharge portion 6 is disposed at a downstream end of the second sheet conveyance path 5 in the sheet conveyance direction. The second sheet discharge portion 6 includes a second discharge outlet 61, a second discharge roller pair 62, and a second discharge tray 63.

The second discharge outlet 61 is positioned at the downstream end of the second sheet conveyance path 5 in the sheet conveyance direction. The second discharge roller pair 62 is disposed at the second discharge outlet 61. The second discharge tray 63 is positioned downstream from the second discharge outlet 61 in the sheet conveyance direction. The sheet that has been conveyed on the second sheet conveyance path 5 to reach the second discharge outlet 61 is caused to pass through the second discharge outlet 61 by the second discharge roller pair 62 to be discharged on the second discharge tray 63. The second discharge tray 63 is one of the locations at which the sheet subjected to post-processing by the sheet post-processor 1 is eventually discharged. Furthermore, a sheet not to be subjected to post-processing, a small-size sheet, and so on are also discharged on the second discharge tray 63.

The third sheet conveyance path 7 branches off from a second branch portion 32 on the first sheet conveyance path 3 to extend downwardly to the third sheet discharge portion 8. A direction directed from the second branch portion 32 toward the third sheet discharge portion 8 is referred to as a sheet conveyance direction on the third sheet conveyance path 7. The second branch portion 32 is positioned downstream from the first branch portion 31 with respect to the sheet conveyance direction on the first sheet conveyance path 3 and at an upstream end of the third sheet conveyance path 7 in the sheet conveyance direction. The third sheet conveyance path 7 includes a plurality of conveyance roller pairs 7*r* and conveys the sheet being conveyed on the first sheet conveyance path 3 so that the conveyance direction of the sheet is changed at the second branch portion 32 toward the third sheet discharge portion 8.

The second branch portion 32 includes a second switching guide 321. The second switching guide 321 pivots to a position at which the sheet being conveyed on the first sheet conveyance path 3 from the sheet carry-in inlet 2 is guided to the first discharge outlet 41 along the first sheet conveyance path 3 and to a position at which the sheet that has been conveyed on the first sheet conveyance path 3 from the sheet carry-in inlet 2 to pass through the second branch portion 32 and has then been switched back is guided to the third sheet conveyance path 7. The second switching guide 321 is connected to a drive mechanism (not shown), and an operation thereof is controlled by the post-processing control portion 10.

The third sheet discharge portion 8 is provided on the side surface of the sheet post-processor 1 opposite to the side surface thereof opposed to the image forming apparatus 200 and below the first sheet discharge portion 4 (near a lower end of the sheet post-processor 1). The third sheet discharge portion 8 includes a third discharge outlet 81, a third discharge roller pair 82, and a third discharge tray 83.

The third discharge outlet 81 is positioned at a downstream end of the third sheet conveyance path 7 in the sheet conveyance direction. The third discharge roller pair 82 is disposed at the third discharge outlet 81. The third discharge tray 83 is positioned downstream from the third discharge outlet 81 in the sheet conveyance direction. The sheet that has been conveyed on the third sheet conveyance path 7 to reach the third discharge outlet 81 is caused to pass through the third discharge outlet 81 by the third discharge roller pair 82 to be discharged on the third discharge tray 83. The third discharge tray 83 is one of the locations at which the sheet subjected to post-processing by the sheet post-processor 1 is eventually discharged.

The post-processing section 9 performs a prescribed type of post processing with respect to the sheet that has been subjected to image formation by the image forming apparatus 200 and has been carried into the sheet post-processor 1. The post-processing section 9 includes the perforation portion 91, a sheet binding unit 92, a sheet folding unit 100, and a bookbinding portion 94.

The perforation portion 91 is disposed in immediate proximity to and downstream from the sheet carry-in inlet 2 on the first sheet conveyance path 3. The perforation portion 91 performs a perforation process with respect to the sheet being conveyed on the first sheet conveyance path 3 so as to form a punch hole therein.

The sheet binding unit 92 is disposed in immediate proximity to and upstream from the first sheet discharge portion 4 with respect to the sheet conveyance direction on the first sheet conveyance path 3. The sheet binding unit 92 performs a staple process (the binding process) with respect to a sheet bundle of a plurality of sheets stacked on each other so as to bind the sheet bundle. A detailed configuration of the sheet binding unit 92 will be described later.

The sheet folding unit 100 is disposed downstream from the perforation portion 91 and upstream from the sheet binding unit 92 with respect to the sheet conveyance direction on the first sheet conveyance path 3. The sheet folding unit 100 performs the folding process with respect to a single sheet so as to form a fold line on the sheet. The sheet folding unit 100 is capable of performing, with respect to a single sheet, the folding process for folding the sheet, for example, in two, in a Z shape, outwardly in three, or inwardly in three.

The bookbinding portion 94 is disposed in immediate proximity to and upstream from the third sheet discharge portion 8 with respect to the sheet conveyance direction on the third sheet conveyance path 7. The bookbinding portion 94 includes a center-folding part 941 and a center-binding part 942. The bookbinding portion 94 performs, with respect to a sheet bundle of a plurality of sheets stacked on each other, a center-folding process and a center-binding process in which the sheet bundle is folded at substantially a center thereof in the sheet conveyance direction and bound into a booklet.

The post-processing control portion (the control portion) 10 includes a CPU, a storage part, and other electronic circuits and electronic components (none of which are shown). The post-processing control portion 10 is communicably connected to the main body control portion 203 in the image forming apparatus 200 (see FIG. 1). Upon receipt of an instruction from the main body control portion 203, based on control programs and data stored in the storage part by use of the CPU, the post-processing control portion 10 controls operations of the various constituent elements provided in the sheet post-processor 1 so as to perform processing related to functions of the sheet post-processor 1. The first sheet conveyance path 3, the first sheet discharge portion 4, the second sheet conveyance path 5, the second sheet discharge portion 6, the third sheet conveyance path 7, the third sheet discharge portion 8, and the post-processing section 9 individually receive instructions from the post-processing control portion 10 and perform post-processing on the sheet in conjunction with each other. A configuration may be adopted in which the main body control portion 203 in the image forming apparatus 200 also assumes functions of the post-processing control portion 10.

[3. Configuration of Sheet Binding Unit]

Figure 3:
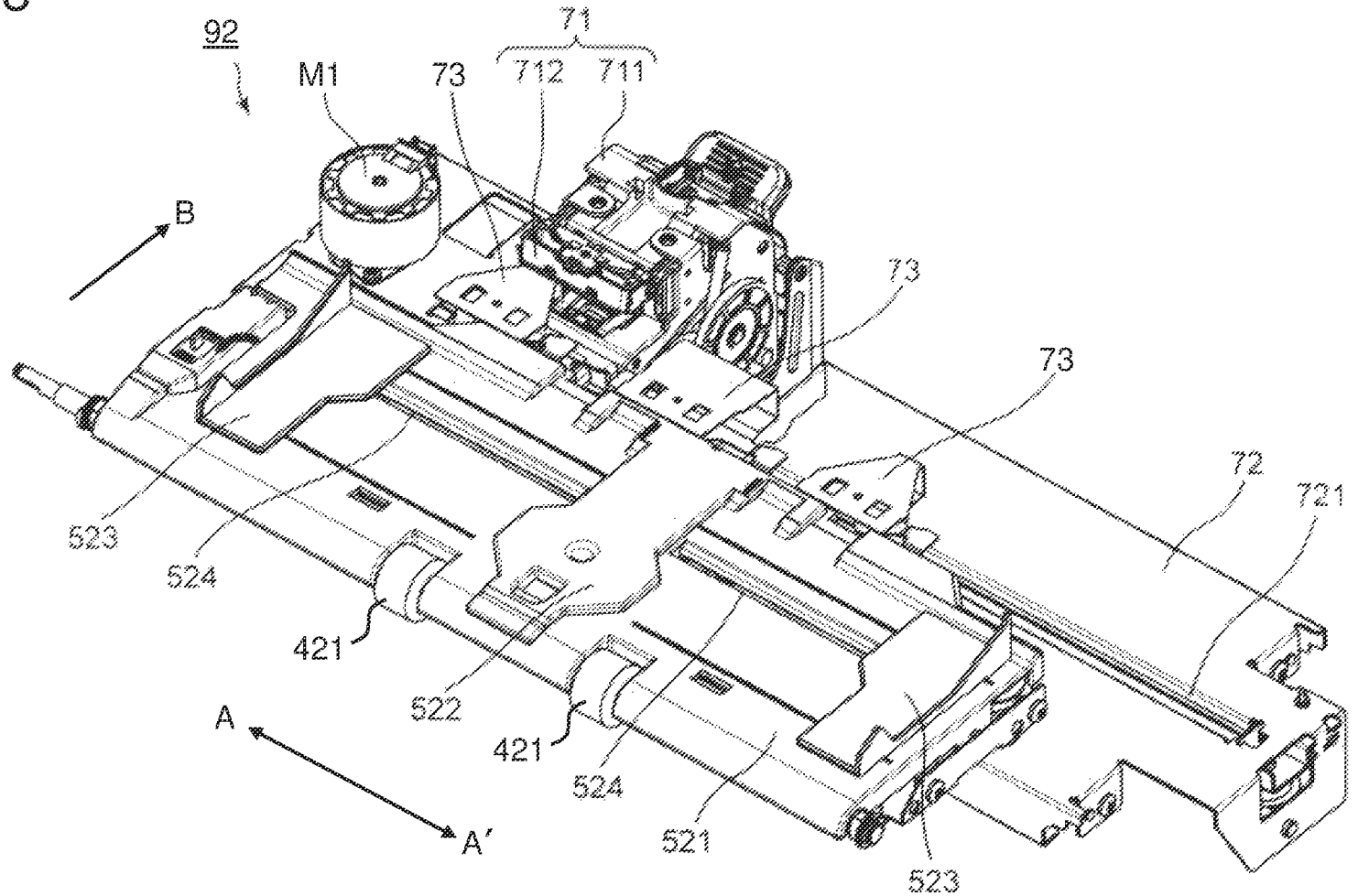
FIG. 3 is a perspective view of a sheet binding unit mounted in the sheet post-processor of the present embodiment.
Figure 4:
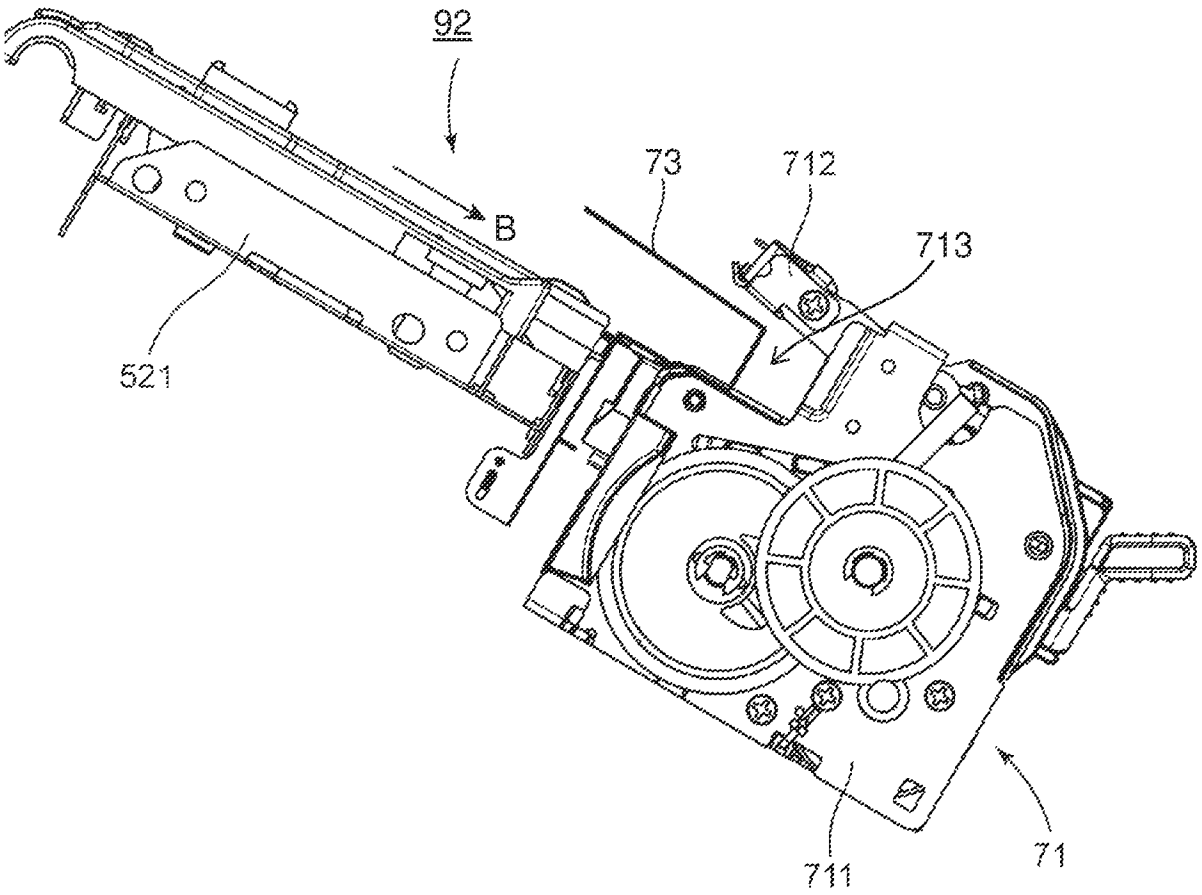
FIG. 4 is a side view of the sheet binding unit.

Next, a description is given of a configuration of the sheet binding unit 92. FIG. 3 is a perspective view of the sheet binding unit 92 mounted in the sheet post-processor 1. FIG. 4 is a side view of the sheet binding unit 92.

As shown in FIG. 3, the sheet binding unit 92 includes a processing tray 521, a staple portion 71, and reference plates 73.

The processing tray 521 is a rectangular tray extending in a sheet width direction (a direction of arrows A and A') and in a carry-in direction. A plurality of sheets S (a sheet bundle) to be subjected to the staple process is loaded on the processing tray 521. In this case, the sheets S are carried onto the processing tray 521 along an alignment direction (opposite to the carry-in direction) directed toward a lower rightward direction (an arrow B direction) in FIG. 4. The sheet bundle that has been subjected to the staple process is eventually sent out toward a direction (an upper leftward direction in FIG. 4) opposite to the above-described alignment direction by the first discharge roller pair 42 (see FIG. 2) to be discharged on the first discharge tray 43 (see FIG. 2). Lower discharge rollers 421 each used as one of rollers constituting the first discharge roller pair 42 are supported at a downstream part of the processing tray 521 in the carry-in direction (a lower left side in FIG. 3).

The processing tray 521 includes a tray center part 522 and width regulation members 523. On an upper surface of the processing tray 521, the tray center part 522 is disposed at a center in the sheet width direction. The tray center part 522 is a thin plate-shaped member secured onto the processing tray 521 at a slight height therefrom.

A pair of width regulation members 523 is disposed so as to interpose the tray center part 522 therebetween in the sheet width direction. The width regulation members 523 regulate a position of the sheet S carried onto the processing tray 521 in the sheet width direction. Each of the width regulation members 523 is formed of a thin plate-shaped member similarly to the tray center part 522 and has an upwardly standing side wall provided at an end thereof in the sheet width direction. The processing tray 521 has a guide groove 524 formed therein to extend along the sheet width direction. The width regulation members 523 are reciprocatable in the sheet width direction along the guide groove 524 via a drive mechanism (not shown) such as a rack and a pinion gear. In the present embodiment, every time the sheet is carried onto the processing tray 521, the width regulation members 523 are caused to reciprocate by the drive mechanism. As a result, the sheet loaded on the processing tray 521 is aligned in the sheet width direction.

The staple portion 71 is disposed to be opposed to an end edge of the sheet on a leading end side thereof in the alignment direction (a right side in FIG. 4). The staple portion 71 is movable in the sheet width direction (the direction of arrows A and A') orthogonal to the carry-in direction along the end edge of the sheet by a drive force of a staple portion drive motor M1 and performs the staple process on the sheet bundle.

As shown in FIG. 4, the staple portion 71 includes a staple main body part 711 and a staple movable part 712. The staple main body part 711 is a main body of the staple portion 71 and contains therein a plurality of staples (not shown). The staple movable part 712 is movable up and down and drives a staple into the sheets S. A concave 713 for receiving the end edge of the sheet is formed between the staple main body part 711 and the staple movable part 712.

The reference plates 73 are secured respectively at three locations spaced from each other in the sheet width direction so as to be opposed to a downstream end of the processing tray 521 in the alignment direction (an upper right side in FIG. 3, a lower right side in FIG. 4). The reference plates 73 each have substantially a U shape open toward upstream in the alignment direction (an upper left side in FIG. 4) when viewed in a cross section orthogonal to the sheet width direction. The reference plates 73 abut on the end edge of the sheet carried onto the processing tray 521, thus aligning the sheet in the alignment direction.

[4. Configuration in Vicinity of Processing Tray in Sheet Binding Unit]

Figure 5:
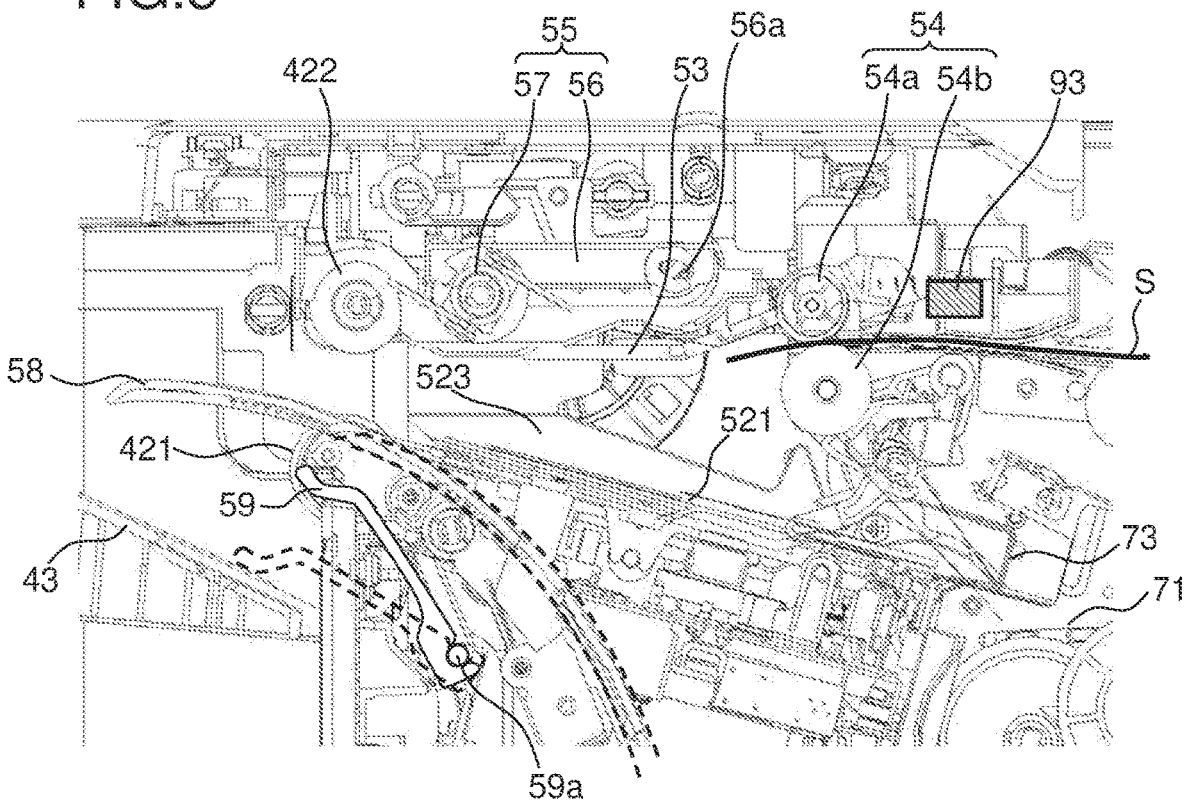
FIG. 5 is a sectional side view showing a structure in a vicinity of a processing tray of the sheet binding unit.

FIG. 5 is a sectional side view showing a structure in a vicinity of the processing tray 521 and an alignment member 55. As shown in FIG. 5, a carry-in roller pair 54 is disposed above the processing tray 521. The carry-in roller pair 54 is composed of an upper carry-in roller 54*a* and a lower carry-in roller 54*b*.

A sheet detection sensor 93 is disposed in a neighborhood of the carry-in roller pair 54. The sheet detection sensor 93 detects a timing when the sheet S passes through the carry-in roller pair 54. As the sheet detection sensor 93, there is used, for example, a PI (photointerrupter) sensor including a detection portion composed of a light emitting part and a light receiving part.

A tapping member 53 and the alignment member 55 are provided downstream from the carry-in roller pair 54 with respect to a carry-in direction of the sheet S (a left side in FIG. 5). The tapping member 53 is supported so as to be swingable along the carry-in direction of the sheet S. At a timing when a trailing end of the sheet S passes through the carry-in roller pair 54, the tapping member 53 swings downward to tap the sheet S downward so that the sheet S is guided onto the processing tray 521.

The alignment member 55 is disposed at each of a plurality of locations (four locations in the present embodiment) along the sheet width direction (a direction perpendicular to a plane of FIG. 5). The alignment member 55 assists in aligning the sheet S carried onto the processing tray 521 by moving (switching back) the sheet S in the alignment direction approaching the reference plates 73. The alignment member 55 includes a paddle holder 56 and an alignment paddle 57.

The paddle holder 56 is supported above the processing tray 521 so as to be swingable along the carry-in direction of the sheet S. By a holder drive motor (not shown), a rotation drive force is inputted to a swing shaft 56*a* of the paddle holder 56. By a drive source (not shown) such as a motor, a rotation drive force in such a direction that the sheet S is sent out in the alignment direction (a counterclockwise direction in FIG. 5) is inputted to the alignment paddle 57. The alignment paddle 57 rotates while abutting on an upper surface of the sheet S carried onto the processing tray 521 to move the sheet S in the alignment direction so that an end edge of the sheet S strikes the reference plates 73, thus aligning the sheet S.

Swinging of the paddle holder 56 is controlled based on a timing of detection by the sheet detection sensor 93. Specifically, at a timing when the sheet detection sensor 93 detects passing of a leading end of the sheet S through the carry-in roller pair 54, the paddle holder 56 is swung upward. As a result, the alignment paddle 57 is separated from the upper surface of the processing tray 521 (or of the sheet S loaded on the processing tray 521).

FIG. 5 shows a state immediately before a new sheet S is carried onto the processing tray 521 in which the paddle holder 56 is swung upward (in a clockwise direction) and the alignment paddle 57 is disposed at a position (a reference position) separated from the processing tray 521. Furthermore, there is released a nip between each of the lower discharge rollers 421 and a corresponding one of upper discharge rollers 422, which constitute the first discharge roller pair 42. Thus, the sheet S that has been carried from the carry-in roller pair 54 onto the processing tray 521 once passes through the first discharge roller pair 42 to project over the first discharge tray 43.

Further, at a timing when a training end of the new sheet S carried onto the processing tray 521 passes below the alignment paddle 57, the paddle holder 56 is swung in a reverse direction (the counterclockwise direction). As a result, the alignment paddle 57 is disposed at a position (an acting position) at which the alignment paddle 57 contacts the upper surface of the sheet S. The above-described operation is repeatedly performed every time the sheet S is carried thereonto, and thus it is possible to achieve reliable contact of the alignment paddle 57 with the upper surface of the sheet S while avoiding interference between the leading end of the sheet S being carried onto the processing tray 521 and the alignment paddle 57.

A support member 58 is disposed below the processing tray 521. The support member 58 is a rod-shaped member having a prescribed width in the sheet width direction and extending in an arc shape in a discharge direction and is disposed below the first discharge outlet 41. To be more specific, the support member 58 is disposed below the processing tray 521 and below relative to a discharge path of the sheet S discharged from the first discharge roller pair 42 along the processing tray 521. In the present embodiment, the support member 58 is disposed at each of two locations in the sheet width direction spaced at a prescribed distance from each other with respect to a center of the processing tray 521 in the sheet width direction.

By a support member drive motor (not shown), the support member 58 is movable between a projected position (a position indicated by a solid line in FIG. 5) projected downstream (a left side in FIG. 5) relative to the first discharge roller pair 42 in the discharge direction and a retracted position (a position indicated by a broken line in FIG. 5) retracted upstream (a right side in FIG. 5) relative to the first discharge roller pair 42 in the discharge direction. When the sheet is carried onto the processing tray 521 (when the sheet is switched back), the support member 58 is disposed at the projected position so as to support a part of the sheet projecting over the first discharge tray 43.

A sheet hold-down member 59 is disposed below the first discharge roller pair 42. The sheet hold-down member 59 is disposed at each of two locations in the sheet width direction spaced at a prescribed distance from each other with respect to the center in the sheet width direction.

The sheet hold-down member 59 is a rod-shaped member having a prescribed width in the sheet width direction and extending in substantially an up-down direction. The sheet hold-down member 59 is supported at a lower end thereof rotatably about a swing shaft 59*a* extending along the sheet width direction as a fulcrum. Based on a control signal from the post-processing control portion 10 (see FIG. 2), the sheet hold-down member 59 swings about the swing shaft 59*a*, with an upper end thereof being a free end. By a hold-down member drive motor M2 (see FIG. 6), the sheet hold-down member 59 is displaced between a hold-down position (a position indicated by a broken line in FIG. 5) at which a bundle of sheets S (hereinafter, simply referred to also as the sheets S) loaded on the first discharge tray 43 is held down from above at an upstream part thereof in the discharge direction and a retracted position (a position indicated by a solid line in FIG. 5) at which a held-down state of the sheets S is released.

Before a start of an operation of discharging the sheet S, the sheet hold-down member 59 is disposed at the hold-down position at which the sheets S loaded on the first discharge tray 43 are held down from above at upstream parts thereof in the discharge direction. When the sheet S is discharged through the first discharge outlet 41, at a timing when the trailing end of the sheet S passes through the first discharge roller pair 42, the sheet hold-down member 59 is moved to the retracted position not projecting toward the first discharge tray 43 (not interfering with discharge of the sheet S). Further, at a timing when loading of the sheet S on the first discharge tray 43 is completed, the sheet hold-down member 59 is moved again from the retracted position to the hold-down position. Every time the sheet S is discharged on the first discharge tray 43, the sheet hold-down member 59 repeatedly performs a sheet hold-down operation described above (movement between the retracted position and the hold-down position).

[5. Operational Control of Sheet Hold-Down Member]

Figure 6:
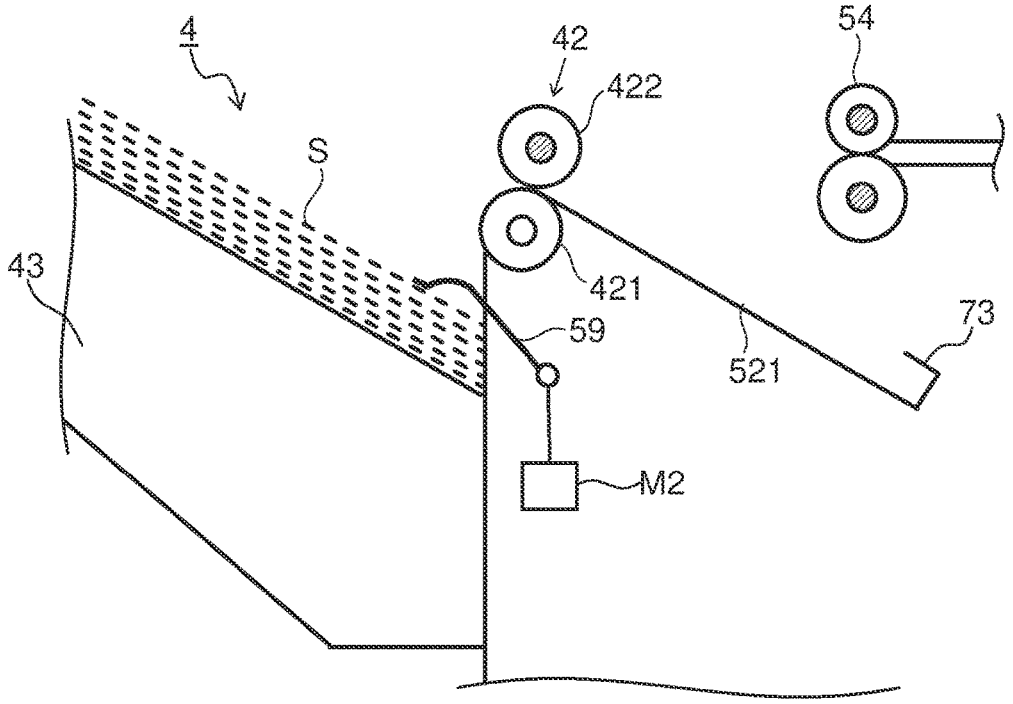
FIG. 6 is a sectional side view schematically showing a vicinity of a first sheet discharge portion of the sheet post-processor, which illustrates a state where sheets have been discharged on a first discharge tray.

Next, a description is given of operational control of the sheet hold-down member 59 in the first sheet discharge portion 4. In the present embodiment, as shown in FIG. 6, in a case where the sheet S discharged through the first discharge outlet 41 is uncurled or curled upwardly, the sheet hold-down member 59 is moved from the retracted position (the position indicated by the solid line in FIG. 5) to the hold-down position.

Figure 7:
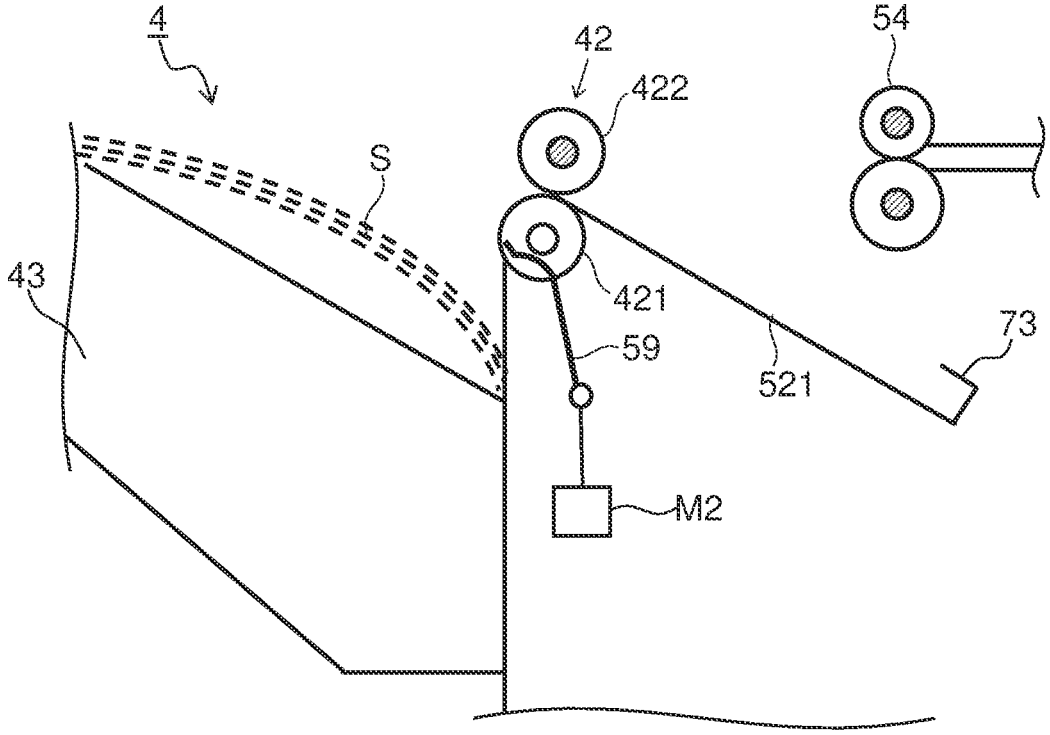
FIG. 7 is a sectional side view schematically showing the vicinity of the first sheet discharge portion of the sheet post-processor, which illustrates a state where downwardly curled sheets have been discharged on the first discharge tray.

On the other hand, as shown in FIG. 7, in a case where the sheet S discharged through the first discharge outlet 41 is curled downwardly, the sheet hold-down member 59 is retained at the retracted position without being moved to the hold-down position. That is, the sheets S loaded on the first discharge tray 43 are not held down at the trailing ends thereof by the sheet hold-down member 59.

Specifically, the post-processing control portion 10 detects a curled state of the sheet S discharged on the first discharge tray 43. Further, in the case where the sheet S is uncurled or curled upwardly, every time a bundle of sheets S is discharged, there is executed the sheet hold-down operation in which the sheet hold-down member 59 is moved between the retracted position and the hold-down position. On the other hand, in the case where the sheet S is curled downwardly, the sheet hold-down member 59 is not moved from the retracted position to the hold-down position.

According to the above-described configuration, only in the case where the sheet S is uncurled or curled upwardly, the sheet hold-down member 59 is moved to the hold-down position, while in the case where the sheet S is curled downwardly, the sheet hold-down member 59 is not moved from the retracted position, and thus it is possible to suppress a phenomenon in which downwardly curled sheets S on the first discharge tray 43 bulge at centers thereof when held down at trailing ends thereof. Accordingly, when discharging the sheet S on the first discharge tray 43, it is possible to suppress interference with the sheets S that have already been loaded on the first discharge tray 43 and thus to suppress defects such as curling of the sheet S at the leading end thereof and positional shifting of the sheet.

A direction of curl of the sheet S varies depending on an orientation of a printing surface of the sheet S. For example, in a case where a sheet of regular paper is used as the sheet S, when ink adheres to the sheet S as a result of printing thereon in the image forming apparatus 200, the printing surface of the sheet S swells with the ink and thus is deformed into a convex shape. That is, the sheet S is curled downwardly when discharged with the printing surface facing upward and is curled upwardly when discharged with the printing surface facing downward.

In a case, however, where the image forming apparatus 200 is an electrophotographic apparatus such as a laser printer, the printing surface (a toner adhering surface) of the sheet S is heated by a heating member (a fixing roller, a fixing belt, or the like) in a fixing portion and thus shrinks to be deformed into a concave shape. That is, the sheet S is curled upwardly when discharged with the printing surface facing upward and is curled downwardly when discharged with the printing surface facing downward.

Furthermore, when the sheet S is a sheet of special paper different from regular paper, the sheet S may be deformed oppositely to the above.

Furthermore, the direction and an amount of curl of the sheet S vary depending also on a type (a thickness, a basis weight, a grain direction) of the sheet S. There is a tendency that the larger the thickness and basis weight of the sheet S, the less likely the leading end of the sheet S is curled, and the smaller the thickness and basis weight of the sheet S, the more likely the leading end of the sheet S is curled.

When the sheet S is a sheet of paper, fibers forming the sheet S tend to be arranged along a direction in which paper travels in a paper machine. The direction in which the fibers are arranged is referred to as the "grain direction" of the sheet S. In a case where the grain direction of the sheet S is parallel to the width direction (a short grain), the sheet S tends to be more likely to be curled. On the other hand, in a case where the grain direction of the sheet S is parallel to the conveyance direction (a long grain), the sheet S tends to be less likely to be curled.

Furthermore, in a case where the image forming apparatus 200 connected to the sheet post-processor 1 is an inkjet recording apparatus, there is a tendency that the larger an amount of ink used for image recording, the larger a moisture amount of the sheet S, and the more likely the sheet S is curled.

In view of the above, in the present embodiment, based on output information related to characteristics of the sheet S, the direction of curl of the sheet S is estimated. Specifically, relationships between the output information related to characteristics of the sheet S (the type of the sheet S such as the thickness, basis weight, grain direction, and so on of the sheet S, the orientation of the printing surface thereof, and the amount of ink thereon) and the direction and amount of curl thereof are experimentally determined in advance. Further, those relationships are tabulated and stored in a storage region (a memory) of the main body control portion 203. Based on an inputted piece of output information related to characteristics of the sheet S, the post-processing control portion 10 estimates the direction of curl of the sheet S. Further, based on a result of the estimation, it is determined whether or not to move the sheet hold-down member 59 from the retracted position to the hold-down position.

Figure 8:
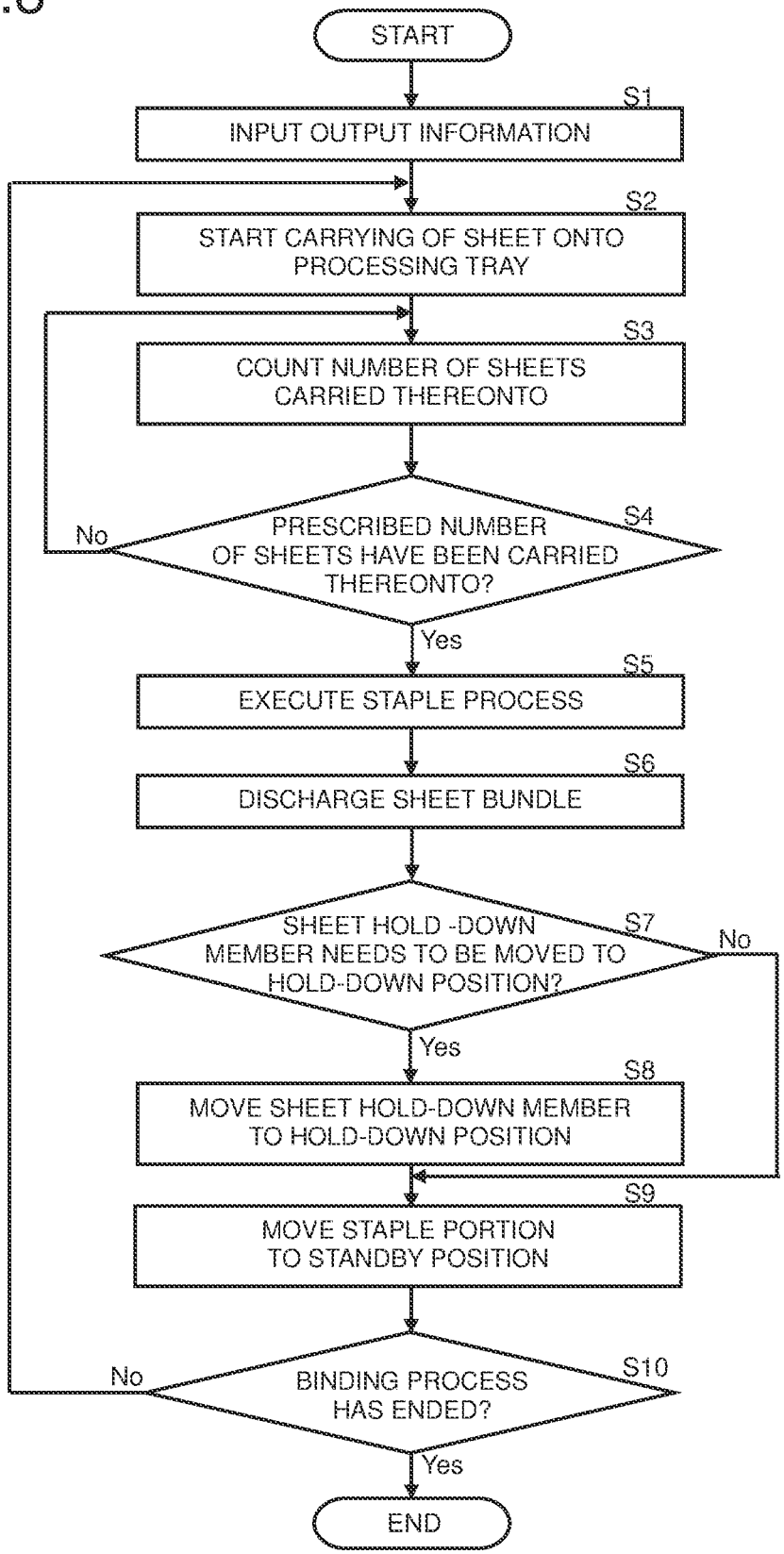
FIG. 8 is a flow chart showing an example of operational control of a sheet hold-down member at a time of sheet discharge in the first sheet discharge portion.

FIG. 8 is a flow chart showing an example of operational control of the sheet hold-down member 59 at a time of sheet discharge in the first sheet discharge portion 4, which is executed in the sheet post-processor 1 of the present embodiment. With reference to FIG. 1 to FIG. 7 where necessary, a description is given of a procedure of an operation of the sheet hold-down member 59 by following steps shown in FIG. 8. It is assumed that, in an initial state, the sheet hold-down member 59 is disposed at the retracted position (the position indicated by the solid line in FIG. 5). Furthermore, in the following description, the output information related to characteristics of the sheet S is simply referred to also as sheet output information.

When a binding process command to perform the binding process on the sheet S is inputted from the main body control portion 203 in the image forming apparatus 200, the output information on the sheet S is inputted together with the binding process command (step S1). Among pieces of the output information on the sheet S, pieces of information related to the type of the sheet S such as a size, the thickness, basis weight, grain direction, and so on of the sheet S are inputted via the operation panel 202 of the image forming apparatus 200. For example, pieces of sheet information such as a name of a manufacturer, a product name, a product number, and so on of the sheet S may be stored in advance in the post-processing control portion 10 (or the main body control portion 203) so as to be associated with the direction of curl of the sheet S. Thus, at a start of a printing job, the name of a manufacturer, product name, product number, and so on of the sheet S used are simply selected via the operation panel 202, and this enables the post-processing control portion 10 to recognize pieces of information related to the type of the sheet S used in the printing job. An input of the orientation of the printing surface is made via the operation panel 202 of the image forming apparatus 200.

As for a piece of information related to the amount of ink, based on image data transmitted from a host apparatus such as a personal computer or the image reading portion 201, an amount of ink used for image recording is calculated by the main body control portion 203 and transmitted from the main body control portion 203.

Next, the post-processing control portion 10 starts to carry, onto the processing tray 521, the sheet S that has been carried into the sheet post-processor 1 via the sheet carry-in inlet 2 (step S2). Specifically, upon the sheet detection sensor 93 detecting that the trailing end of the sheet S has passed through the carry-in roller pair 54, the post-processing control portion 10 (see FIG. 2) controls the tapping member 53 to tap the trailing end of the sheet S so that the sheet S is guided onto the processing tray 521 and then controls the paddle holder 56 to swing downward for a prescribed amount. This causes the alignment paddle 57 to move to the acting position at which a paddle part 572 thereof contacts the upper surface of the sheet S. The alignment paddle 57 is rotated in this state, thus causing the sheet S to be drawn in the alignment direction (the arrow B direction) along the processing tray 521.

After that, the sheet S is sent further downstream in the alignment direction by the alignment paddle 57 and loaded in a state of being aligned in the sheet width direction by the width regulation members 523 (see FIG. 3) and aligned in the alignment direction by the reference plates 73 (see FIG. 3).

The post-processing control portion 10 counts the number of sheets S carried onto the processing tray 521 (step S3). Further, every time a single (or a prescribed number of) sheet(s) S is/are carried thereonto, a stop position of the paddle holder 56 is moved upward so that the acting position of the alignment paddle 57 is moved upward in a continuous manner.

Next, the post-processing control portion 10 determines whether or not the prescribed number of sheets S have been carried onto the processing tray 521 (step S4). In a case where the prescribed number of sheets S have not been carried thereonto (No at step S4), a return is made to step S3 at which carrying of the sheet S onto the processing tray 521 and counting of the number of sheets S carried thereonto are continuously performed.

In a case where the prescribed number of sheets S have been carried thereonto (Yes at step S4), the post-processing control portion 10 transmits a control signal to the staple portion drive motor M1 (see FIG. 3) so as to move the staple portion 71 to a prescribed staple position. After the staple portion 71 has moved to the staple position, the post-processing control portion 10 transmits a control signal to the staple portion 71 so as to execute the staple process on the plurality of sheets S aligned by the reference plates 73 (step S5).

Next, the post-processing control portion 10 controls the rollers constituting the first discharge roller pair 42 to contact each other (form a nip) and the first discharge roller pair 42 to rotate in the discharge direction. This causes the bundle of sheets S thus subjected to the staple process to be discharged on the first discharge tray 43 (both of these are shown in FIG. 2) (step S6).

Based on an inputted piece of output information on the sheet S, the post-processing control portion 10 determines whether or not the sheet hold-down member 59 needs to be moved from the retracted position to the hold-down position (step S7). In a case where it is determined that the sheet hold-down member 59 needs to be moved to the hold-down position (Yes at step S7), the post-processing control portion 10 transmits a control signal to the hold-down member drive motor M2 (see FIG. 6) so that every time a single bundle of sheets S is discharged on the first discharge tray 43, movement of the sheet hold-down member 59 from the retracted position to the hold-down position is repeatedly executed (step S8).

For example, in a case where, based on the piece of output information on the sheet S (the thickness, basis weight, and grain direction of the sheet S, the orientation of the printing surface thereof, the amount of ink thereon), the sheet S is predicted to be uncurled or curled upwardly, it is determined that the sheet hold-down member 59 needs to be moved from the retracted position to the hold-down position.

On the other hand, in a case where it is determined that the sheet hold-down member 59 does not need to be moved to the hold-down position (No at step S7), the post-processing control portion 10 performs control so that the sheets S are discharged on the first discharge tray 43 without the sheet hold-down member 59 being moved from the retracted position. For example, in a case where, based on the piece of output information on the sheet S, the sheet S is predicted to be curled downwardly, it is determined that the sheet hold-down member 59 does not need to be moved to the hold-down position.

After the bundle of sheets S has been discharged, the post-processing control portion 10 transmits a control signal to the staple portion drive motor M1 so as to move the staple portion 71 to a standby position (step S9).

After that, the post-processing control portion 10 determines whether or not the binding process has ended (step S10). In a case where the binding process is being continuously performed (No at step S10), a return is made to step S2, and there are repeatedly performed carrying of the sheet S onto the processing tray 521 and counting of the number of sheets S carried thereonto, execution of the staple process by the staple portion 71, determination as to whether or not the sheet hold-down member 59 needs to be moved, discharging of a sheet bundle, and movement of the staple portion 71 to the standby position (steps S2 to S9). In a case where the binding process has ended (Yes at step S10), the process is ended without any further action.

According to the control example shown in FIG. 8, based on the output information on the sheet S, it is determined whether or not the sheet hold-down operation by the sheet hold-down member 59 needs to be performed. Therefore, the sheet S can be stably discharged on the first discharge tray 43 and loaded thereon in an aligned state without being affected by a direction of curl of the sheet S varying depending on the type of the sheet S and the amount of ink used for image recording by an inkjet recording apparatus.

While the foregoing has described the embodiment of the present disclosure, the present disclosure is not limited in scope thereto and can be implemented by being variously modified without departing from the spirit of the invention. For example, while in the foregoing embodiment, based on the output information on the sheet S, the post-processing control portion 10 automatically determines whether or not to execute the sheet hold-down operation by the sheet hold-down member 59, a configuration may be adopted in which a user can move the sheet hold-down member 59 at any timing. For example, in a possible configuration, the operation panel 202 has a maintenance mode in which a position of the sheet hold-down member 59 is switched between the retracted position and the hold-down position so that a user can switch the position of the sheet hold-down member 59 in accordance with a loaded status (an alignment property) of the sheets S on the first discharge tray 43.

With the above-described configuration, even in a case where a degree of downward curl of the sheet S is actually larger than assumed, it is possible to stop the sheet hold-down member 59 from moving to the hold-down position in consideration of a discharged status of a bundle of sheets S on the first discharge tray 43.

Furthermore, while the foregoing embodiment describes an example in which, by the sheet binding unit 92, the binding process is performed on the sheets S loaded on the processing tray 521, the present disclosure is not limited thereto, and a configuration may be adopted in which a shift discharge process or the folding process is performed on the sheets S loaded on the processing tray 521.

Furthermore, while in the foregoing embodiment, information related to the type of the sheet S is inputted via the operation panel 202 of the image forming apparatus 200, a configuration may be adopted in which the information related to the type of the sheet S is automatically acquired. For example, a media sensor can be disposed at any position on a sheet conveyance path from the image forming apparatus 200 to the sheet post-processor 1 and used to detect information related to the sheet S such as the thickness, basis weight, and grain direction of the sheet S carried from the image forming apparatus 200 into the sheet post-processor 1 and the amount of ink thereon.

For example, in detecting the thickness of the sheet S, there can be used, as the media sensor, a laser coaxial displacement meter that includes two optical sensors used to detect the thickness of the sheet S by interposing the sheet S therebetween.

In detecting the basis weight of the sheet S, there can be used, as the media sensor, a basis weight sensor that uses a light transmittance through the sheet S to measure the basis weight. A relationship between the light transmittance and the basis weight varies depending on the type of the sheet S, and thus it is required to select an optimum basis weight conversion formula for each type of the sheet S. Furthermore, it is also possible to calculate a density [$g/m^3$] of the sheet S by dividing the basis weight [$g/m^3$] by the thickness [m].

In detecting the grain direction of the sheet S, as the media sensor, for example, an imaging device is used to photograph a transmission image of the sheet S being conveyed while receiving LED light applied thereto from a rear side thereof. The transmission image thus photographed is compared with a reference image stored in advance in the main body control portion 203, and thus the grain direction of the sheet S is detected. Alternatively, as the media sensor, an ultrasonic measuring device can also be used to measure a reflection waveform from the sheet S receiving ultrasonic waves applied thereto. The reflection waveform thus measured is compared with a reference waveform stored in advance in the main body control portion 203, and thus the grain direction of the sheet S is detected.

In detecting the type of the sheet S, there is used a paper type determination algorithm in which the density, a surface property (specular reflection light, diffusion light), the basis weight, or the like of the sheet S is used to determine the type of the sheet S.

Furthermore, as the media sensor, there is used a moisture meter that detects a moisture content of the sheet S, and thus the amount of ink on the sheet S can be detected.

Furthermore, while the foregoing embodiment exemplarily uses an inkjet recording apparatus as the image forming apparatus 200, a printer or a copy machine employing an electrophotographic scheme can also be used as the image forming apparatus 200. In an inkjet recording scheme in which ink is ejected to the sheet S, the sheet S is more likely to be curled than in the electrophotographic scheme. The present disclosure, therefore, is particularly useful for the sheet post-processor 1 to which an inkjet recording apparatus is connected as the image forming apparatus 200.

Furthermore, while the foregoing embodiment exemplarily uses, as the sheet discharger of the present disclosure, the first sheet discharge portion 4 in the sheet post-processor 1 connected to the image forming apparatus 200, the sheet discharger of the present disclosure is applicable also to a sheet discharge portion in the image forming apparatus 200 used without being connected to the sheet post-processor 1.

The present disclosure is usable in a sheet discharger that discharges a sheet, and a sheet post-processor, an image forming apparatus, and an image forming system that are provided with the sheet discharger.

What is claimed is:

1. A sheet discharger, comprising:

a sheet discharge outlet through which a sheet is discharged;

a discharge member that is disposed at the sheet discharge outlet and conveys the sheet in a discharge direction;

a sheet discharge tray that is disposed downstream from the sheet discharge outlet with respect to the discharge direction and on which the sheet discharged through the sheet discharge outlet is loaded;

a sheet hold-down member that is disposed below the sheet discharge outlet and is swingable between a hold-down position at which the sheet loaded on the sheet discharge tray is held down at an upstream part thereof in the discharge direction and a retracted position retracted upward from the hold-down position;

a drive portion that drives the sheet hold-down member; and a control portion that controls the drive portion, wherein the control portion is capable of executing, every time the sheet is discharged on the sheet discharge tray, a sheet hold-down operation in which the sheet hold-down member disposed at the hold-down position is moved to the retracted position at a timing when a trailing end of the sheet discharged through the sheet discharge outlet passes through the discharge member, and the sheet hold-down member is moved from the retracted position to the hold-down position at a timing when loading of the sheet on the sheet discharge tray is completed, and the control portion determines, in accordance with characteristics of the sheet, whether or not to execute the sheet hold-down operation, based on output information related to the characteristics of the sheet, the control portion estimates a direction of curl of the sheet discharged through the sheet discharge outlet, and when the sheet discharged through the sheet discharge outlet is uncurled or curled upwardly, the sheet hold-down operation is executed, while when the sheet is curled downwardly, the sheet hold-down member is maintained to be disposed at the retracted position.

2. The sheet discharger according to claim 1, wherein the output information related to the characteristics of the sheet includes at least one of a thickness of the sheet, a basis weight of the sheet, a grain direction of the sheet, and an orientation of a printing surface of the sheet.

3. A sheet post-processor, comprising:

a processing section that performs a prescribed type of post-processing on a sheet; and the sheet discharger according to claim 1, the sheet discharger discharging the sheet subjected to the prescribed type of post-processing by the processing section.

4. An image forming system, comprising:

an image forming apparatus that forms an image on a sheet; and the sheet post-processor according to claim 3, the sheet post-processor performing the prescribed type of post-processing on the sheet on which the image has been formed by the image forming apparatus.

5. An image forming system, comprising:

an image forming apparatus that forms an image on a sheet; and a sheet post-processor including:

a processing section that performs a prescribed type of post-processing on the sheet; and the sheet discharger according to claim 1, the sheet discharger discharging the sheet subjected to the prescribed type of post-processing by the processing section, wherein the image forming apparatus is an inkjet recording apparatus that ejects ink to the sheet so as to perform image recording thereon, and the output information related to the characteristics of the sheet includes an amount of ink used for the image recording on the sheet.

6. An image forming apparatus, comprising:

an image forming portion that forms an image on a sheet; and the sheet discharger according to claim 1, the sheet discharger discharging the sheet on which the image has been formed by the image forming portion.

7. The image forming apparatus according to claim 6, wherein the image forming portion ejects ink to the sheet so as to perform image recording thereon.

8. An image forming system, comprising:

an image forming apparatus that forms an image on a sheet; and a sheet post-processor including:

a processing section that performs a prescribed type of post-processing on the sheet; and the sheet discharger according to claim 2, the sheet discharger discharging the sheet subjected to the prescribed type of post-processing by the processing section, wherein the image forming system further includes:

an input portion for inputting the output information related to the characteristics of the sheet.

9. The image forming system according to claim 8, wherein a position of the sheet hold-down member is changeable through an input operation with respect to the input portion.

* * * * *